US009637916B1

(12) United States Patent
Lytle

(10) Patent No.: US 9,637,916 B1
(45) Date of Patent: May 2, 2017

(54) WORK-STATION

(71) Applicant: Frank Lytle, West Chester, PA (US)

(72) Inventor: Frank Lytle, West Chester, PA (US)

( * ) Notice: Subject to any disclaimer, the term of this patent is extended or adjusted under 35 U.S.C. 154(b) by 0 days.

(21) Appl. No.: 15/210,929

(22) Filed: Jul. 15, 2016

(51) Int. Cl.

| | |
|---|---|
| ***E04H 1/00*** | (2006.01) |
| ***E04B 2/72*** | (2006.01) |
| ***E04B 2/74*** | (2006.01) |
| ***E04B 1/99*** | (2006.01) |
| ***E04C 2/20*** | (2006.01) |
| ***E04C 2/34*** | (2006.01) |
| ***E04B 2/00*** | (2006.01) |
| *E04C 2/00* | (2006.01) |

(52) U.S. Cl.
CPC ..... *E04B 2/7403* (2013.01); *E04B 1/99* (2013.01); *E04C 2/20* (2013.01); *E04C 2/34* (2013.01); *E04C 2/46* (2013.01); *E04C 2002/005* (2013.01); *E04C 2002/3488* (2013.01)

(58) Field of Classification Search
CPC . E04B 2/7403; E04B 1/99; E04C 2/20; E04C 2/34; E04C 2/46; E04C 2002/3488; E04C 2002/005
See application file for complete search history.

(56) References Cited

U.S. PATENT DOCUMENTS

| | | | | |
|---|---|---|---|---|
| 2,218,992 | A | | 10/1940 | Munroe |
| 2,659,807 | A | | 11/1953 | Wakefield |
| 2,870,857 | A | | 1/1959 | Goldstein |
| 2,975,853 | A | | 3/1961 | Friend |
| 3,132,714 | A | | 5/1964 | Gary, Jr. |
| 3,147,926 | A | | 9/1964 | Rosenblatt |
| 4,047,351 | A | | 9/1977 | Derner et al. |
| 4,761,921 | A | | 8/1988 | Nelson |
| 4,787,296 | A | * | 11/1988 | Huang ..... E06B 3/6707 181/289 |
| 4,829,728 | A | | 5/1989 | Castelli |
| 4,986,194 | A | | 1/1991 | Bollman |
| 5,172,530 | A | | 12/1992 | Fishel et al. |
| 5,532,440 | A | | 7/1996 | Fujiwara |
| 5,742,307 | A | | 4/1998 | Watrobski et al. |
| 5,896,710 | A | | 4/1999 | Hoyle |
| 5,897,325 | A | * | 4/1999 | Koby-Olson ..... E04H 1/125 434/236 |
| 6,615,550 | B2 | | 9/2003 | Reuschel et al. |
| 7,658,199 | B2 | | 2/2010 | Ayers et al. |
| 9,169,644 | B2 | * | 10/2015 | Conterno ..... E04D 3/28 |
| 2007/0294953 | A1 | | 12/2007 | Guillen |
| 2015/0128508 | A1 | | 5/2015 | Zickmantel |

* cited by examiner

*Primary Examiner* — Patrick Maestri
(74) *Attorney, Agent, or Firm* — Invention to Patent Services; Alex Hobson

(57) ABSTRACT

A work-station utilizes sound absorbing, translucent enclosure panels that allows light from outside of the work-station to enter. The translucent enclosure panels have an outside panel, and intermediate panel and an inside panel of a translucent plastic sheet material that form cells for dampening sound transmission through the enclosure panels. The inside panel has a plurality of apertures to allow sound to enter and be dissipated within the internal cells. A sound masking device is configured within the work-station and projects a dampening sound into the work-station, such as along the opening to work-station to produce a masking sound curtain for sound entering the work-station.

22 Claims, 3 Drawing Sheets

WORK-STATION

BACKGROUND OF THE INVENTION

Field of the Invention

The invention relates to work-stations.

Background

Work-stations, also referred to as cubicles, have become an economical way for companies to efficiently use office floor space. Work-stations enable a large number of workers to work side by side with limited privacy and barriers to distraction. Most work-stations are three sided and have no ceiling. To provide some dampening of outside noise, masking audio is often projected from the ceiling above a set of work-stations or a work-station area. People often find that the sound masking does not adequately mask all sounds, as some surrounding sounds can enter through the open face of the work-station or reflect off of the ceiling above the work-station, walls, floor and any hard surface into a person's workstation. Many people report that they can very clearly hear noises and conversations from a particular proximal work-station due to direct sound and the reflection issue. Some employers try to abate these issues by increasing the sound masking volume, thereby making conversations outside of work-stations and in the open areas more difficult.

Work-stations are relatively small enclosures that can be dark and somewhat cave like with only a single open face. These work-stations leave occupants feeling detached and isolated from their nearby work associates. Many people complain that the work-stations are too dark, as they are typically made of textile covered panels that block the light from offset overhead lighting and ambient light from windows around the building. The light entering the work-station is therefore limited to direct light from overhead, or light entering through the open face of the workstation. For this reason, opaque walled work-stations typically require additional lighting within each of the work-stations; costing the employer additional money in energy and maintenance costs.

There exists a need for a work-station that allows more ambient lighting to enter, one that more effectively reduces outside sound distractions and that leaves people feeling connected and able to more easily see what is happening around them.

SUMMARY OF THE INVENTION

The invention is directed to a work-station that comprises sound absorbing translucent enclosure walls that allow ambient light to enter and a sound masking device within the workstation that effectively reduces outside sound distractions. An exemplary work-station comprises four translucent enclosure panels, three connected sound absorbing and translucent walls and a translucent ceiling. The ceiling is attached to the three walls thereby preventing reflected sounds from the exterior room ceiling from entering through an open top of the work-station. An exemplary work-station comprises a sound masking device within the enclosure and in a preferred embodiment, the sound masking device is configured to project sound across the open face, or entrance to create a sound masking curtain.

An exemplary work-station comprises three translucent and sound absorbing walls, a left-side wall, a right-side wall and a connector wall extending between the left-side and right-side walls, thereby leaving an opening and a partially enclosed space, or enclosure. An exemplary work-station comprises a ceiling that may also be translucent and/or sound absorbing. A work-station may define an enclosure having a width, a depth and a height, all measured across the interior of the work-station. An exemplary work-station may have a width that is more than about 3 ft (0.91 m), more than about 4 ft (1.22 m), more than about 5 ft (1.52 m), more than about 8 ft (2.44 m), less than about 10 ft (3.05 m), less than about 6 ft (1.83 m) and any range between and including the width values provided, such as no more than about 10 ft (3.05 m), and greater than about 3 ft (0.91 m). Likewise, a work-station depth, or distance from the open face to the connector wall, may be more than about 3 ft, more than about 4 ft (1.22 m), more than about 5 ft (1.52 m), more than about 8 ft (2.44 m), less than about 10 ft (3.05 m), less than about 6 ft (1.83 m) and any range between and including the depth provided. The height of an exemplary work-station, as measured from the floor to the inside surface of the ceiling, may be greater than about 6 ft, greater than about 8 ft, greater than about 10 ft (3.05 m), less than about 10 ft (3.05 m), and any range between and including the height values provided. The interior volume of an exemplary work-station may have any combination of width, depth and height as described herein. For example, an exemplary work-station may have an interior volume defined by a width of 8 ft (2.44 m), a depth of 6 ft (1.83 m) and a height of 8 ft (2.44 m), or 384 $ft^3$ (10.87 $m^3$).

An exemplary work-station has all four enclosure panels, the three walls and the ceiling, made of translucent panels. An exemplary translucent panel comprises an inside panel, an outside panel and an intermediate panel configured between the inside and outside panels. The inside, outside and intermediate panels, or individual panels, extend in parallel with each other at offset distances that creates an air space, or septum, between the panels having a gap distance between the adjacent and parallel panels. The distance between the inside panel and the intermediate panel is the inside gap distance and the distance between the outside panel and the intermediate panel is the outside gap distance. An exemplary translucent panel comprises struts that extend between the inside panel and the intermediate panel as well as between the outside panel and the intermediate panel to support the individual panels at the inside and outside gap distances from each other and to create cells. A gap distance, or distance between the inside or outside panel to the intermediate panel may be more than about 0.25 ich (6.35 mm), more than about 0.375 inch (9.525 mm), more than about 0.5 inch (12.7 mm), no more than about 2 inches (50.8 mm), no more than about 1 inch (25.4 mm) no more than about 0.75 inch (19.05 mm) and any range between and including the gap distances provided. The inside gap distance and outside gap distances may be about the same or the inside and outside gap distances may be substantially different, such as at least 50% different in dimension. The inside and outside struts have a strut thickness that may be kept relatively small to enable a high amount of light transmission through the translucent enclosure panel, such as no more than about 0.125 inch (3.175 mm), no more than about 0.25 inch (6.35 mm), no more than about 0.0675 inch (1.71 mm) and any range between and including the thickness values provided. Exemplary translucent panels comprise struts that extend across the gap between the individual panels to support the panels and to create cells. The struts may extend horizontally and/or vertically. In an exemplary embodiment, the struts extend horizontally along the wall panels creating cells that are horizontal channels that extend across the entire width of each wall panel. The outside cells and inside cells may be defined by struts that are aligned, thereby providing more light transmission, as offset struts may further hinder light transmission over a greater surface area of the panel. In an exemplary embodiment, the outside panel struts and inside panel struts are aligned with each other and extend horizontally across the wall panels to create horizontal cell channels. The struts may be offset from each other by a distance that enables adequate support of the translucent panel but that minimizes light transmission reduction. Struts may have an offset distance of more than about 0.5 inch (12.7 mm), more than about 1 inch (25.4 mm), more than about 2 inches (50.8), no more than about 7 inches (17.78 cm), no more than about 6 inches (15.24 cm), no more than 5 inches (12.7 cm), no more than 2.5 inches (6.35 cm) or any range between and including the values provided such as from about 0.5 inch (1.27 cm) to 2.5 inches (6.35 cm). An exemplary wall panel comprises inside and outside struts that are aligned with each other, extend horizontally and are offset from each other from about 0.5 inch (1.27 cm) to 2.5 inches (6.35 cm). An exemplary work-station comprises wall panels and a ceiling that are translucent, allowing at least 60% of light to pass through, according to ASTM D1003 Standard Test Method for Haze and Luminous Transmittance of Transparent Plastics, or ASTM D1494 Standard Test Method for Diffuse Light Transmission Factor of Reinforced Plastics Panels, or ASTM E972, Standard test method for solar photometric transmittance of sheet materials using sunlight, or ASTM E1084-Standard test method for solar transmittance (terrestrial) of sheet materials using sunlight; this method includes direct, diffuse, and reflected light. In a preferred embodiment, the panels of the work-station allow at least 70% of light to pass through, at least 75% of light to pass through, at least 85% of light to pass through, and more preferably at least 90% of light to pass through. Translucent enclosure panels are defined herein as being transparent if they allow at least 80% of light to pass therethrough according to ASTM D1003.

An exemplary work-station may comprise enclosure panels that are transparent or translucent and allow clear visibility through the enclosure panel(s), such as better than 20/40 when measured using a conventional Snellen chart. In an alternative exemplary embodiment, the panels of the work-station allow light to pass through but obscure visibility into and out of the work-station. The panels may diffract light in such a way that visibility through the panel in reduced, whereby occupants within the panel are not distracted by watching events through the panel walls, for example. Likewise, an obscure panel may provide occupants with some level of privacy, wherein people outside of the panel cannot dearly see through the walls. A panel of the work-station is defined herein as an obscuring panel if visibility through the work-station panel is reduced to no better than 20/40, and preferably no better than 20/70, as defined by a standard vision test, utilizing a traditional Snellen chart configured no more than 5 ft (1.52 m) behind the translucent panel, or within the work-station. The test is to be conducted with a test subject that has at least 20/20 vision without the translucent panel configured between the subject and the Snellen chart. A translucent, yet obscuring work-station may provide a great combination of connectivity with the outside environment while reducing distractions and providing adequate privacy. A translucent and obscuring panel may comprise a layer or an individual panel that has an index of diffraction that substantially different from the index of diffraction of the one of the other individual panels. Likewise, the struts extending across the panel may effectively obscure vision, when vision through the panel is evaluated at an offset distance of at least one foot or more from the translucent panel. One of more of the inside, outside, or intermediate panels of a translucent enclosure panel may reduce visibility through index of refraction variations between layers or through the thickness of the panel, or comprise an obscuring film, or coating that reduces visibility. For example, a coating or film may be applied to the inside panel that creates a marbled distortion to visibility, due to index of refraction differences with the inside panel, the thickness of the obscuring film and/or the pattern. An obscuring coating, for example may be a discontinuous coating that is applied in a uniform or non-uniform pattern across the surface of the panel, and/or in thickness.

The inside, outside and intermediate panels of a translucent enclosure panel may all be made of materials that have translucent properties at least as high as the translucent values provide for the translucent enclosure panel. These individual panels, inside, outside, and intermediate panels, may be made of glass but more preferably are made of polymer, such as a polyester, acrylic, polyethylene, and the like. An individual panel may be effectively thick to provide adequate structural support while allowing adequate light transmission, such as at least about 0.125 inch thick, at least about 0.25 inch (6.35 mm) thick, at least about 0.5 inch (12.7 mm) thick, no more than about 1.0 inch (25.4 mm) thick, no more than about 0.5 inch (12.7 mm) thick and any range between and including the thickness values provided. The struts may have a similar thickness as the thickness of the individual panels.

An enclosure panel may comprise a plurality of apertures in the inside or outside surface to absorb sound into the cells. In a preferred embodiment, the enclosure panel comprises apertures in the inside panel, thereby allowing sound within the work-station to be absorbed and reduced. The apertures may be of a size or sizes and distribution over the surface of the panel to effectively allow sound of one or more frequencies to enter and be damped by reflections within the panel cell. In an exemplary embodiment, the apertures have a coverage area, or comprise a percentage of the panel surface that is at least about 20%, at least about 40%, at least about 60%, no more than 80%, no more than 60%, and any range between and including the coverage area percentages provided, such as between about 20% and 60%. The structural integrity of the wall panels must be considered when designing a sound absorbing aperture wall panel.

The intermediate panel may comprise a plurality of apertures and these apertures may be configured in a similar manner as those described in the inside panel, or may have a dissimilar configuration. For example, the plurality of aperture in the intermediate panel may have coverage area that less than the coverage area of the inside panel apertures, such as about 75% or less of the coverage area of the inside panel, about 50% or less of the coverage area of the inside panel, about 25% or less of the coverage area of the inside panel and any range between and including the percentage differences provided. In addition, the plurality of intermediate panel apertures may have an aperture dimension, or average aperture dimension that is significantly different from the average inside panel aperture dimension. For example, the inside panel may an average aperture dimension of about 3 mm and the intermediate panel may have an average aperture dimension of about 1 mm or less. The intermediate panel may have aperture sizes configured to allow lower or higher frequencies through, whereas the inside panel may be configured to allow the opposite frequency through. Furthermore, the inside panel may have a patterned aperture configuration and the intermediate panel may comprise a random aperture configuration.

An exemplary enclosure panel may comprise apertures over the entire surface of the panel, such as the inside surface of the enclosure panel, or substantially the entire surface, such as at least about 75% of the inside surface, or more preferably at least 80% of the inside surface and even more preferably at least about 90% of the inside surface of the enclosure panel, or in the inside panel of the enclosure panel. In an exemplary embodiment, the enclosure panels are made with apertures extending over the entire inside surface of left-side, right-side, and connector walls.

The apertures may be the same size, or may be a plurality of sizes. An aperture may have a dimension, maximum distance across the aperture or diameter, that is at least about 1 mm, at least about 2 mm, at least about 4 mm, at least about 5 mm, no more than about 7 mm, no more than about 6 mm, no more than about 5 mm and any range between and including the aperture dimensions provided, such as between about 1 mm and 5 mm. In an exemplary embodiment, a first aperture has an aperture dimension that is at least double a second aperture dimension. For example, an enclosure panel may have a plurality of first apertures that are circular in shape and have an aperture dimension, or diameter, of about 1 mm, and a plurality of second apertures that are also circular in shape and have an aperture diameter of 4 mm, or four times that of the first aperture. Apertures of different aperture dimensions may be designed for allowing sound of certain frequencies to enter. An exemplary enclosure panel may comprise a plurality of apertures that are configured randomly over the surface or in a pattern. A pattern may a repeating variation in layout of apertures, wherein in one location the aperture pattern, such as distance between and/or number and size, is different from an aperture pattern in a second location, however the fluctuating pattern is repetitive over the surface of the enclosure panel.

The unique structure of the enclosure panels reduces outside sound from entering the work-station and sound produced within the work-station, including a masking sound, from exiting the work-station. The outside panel may reflect much of the outside sounds, and the outside cells may further absorb outside sounds. The intermediate panel, inside cells, and inside panel may further reduce outside sound transmission into the work-station. Likewise, the inside panel may reflect a portion of sound generated within the work-station and is configured to let some sound pass into the inside cells. Inside sounds entering into the inside cells may be dampened within the inside cells and the intermediate panel, outside cells and outside panel may further reduce sound transmission from within the work-station to the outside. The unique configuration of the work-station, as described herein, and in particular, the unique structure of the enclosure panels may effectively prevent sound transmission into and out of the work-station, whereby sound generated within the work-station is not clearly audible when standing no closer than about 6 ft (1.83 m) from the work-station, no closer than about 4 ft (1.22 m) from the work-station and preferably no closer than about 3 ft (0.91 m) from the work-station, including from the opening to the work-station.

An exemplary work-station comprises translucent enclosure panels that have outside cells and inside cells. The outside cells and inside cells effectively reduce sound from passing through the enclosure panel, wherein they provide at least a 10 decibel (dB) reduction in sound, at least 20 dB reduction in sound and more preferably a 30 dB reduction in sound when tested according to ASTM C423, Standard Test Method for Sound Absorption and Sound Absorption Coefficients by the Reverberation Room Method. Exterior sound to the work-station is reflected off of the outside surface of the work-station, or the outside panel surface, which, in an exemplary embodiment, is smooth, flat and non-porous. Any sound passing through the outside panel will be dampened within the gaps and cells of the translucent enclosure panel. Any sound transmitted through the outside panel will be absorbed and/or dampened within the outside cells primarily and also by the inside cells as well as the intermediate panel and the inside panel. Any sound transmitted through the outside panel may reflect off the intermediate panel and bound back and forth between the intermediate panel and the outside panel, thereby dampening the sound and preventing it from passing through to the interior of the work-station. Sound produced within the work-station may be absorbed and/or dampened within the inside cells of the work-station, wherein sound enters into the inside cells through a plurality of apertures in the inside panel that allow sound to enter into the inside cells. Some interior produced sounds will reflect off inside panel and some will be transmitted into the inside cells through said apertures.

An exemplary translucent sound-absorbing work-station further comprises a sound masking device that is configured to produce a masking sound within the work-station enclosure. Locating a sound masking device within a work-station more effectively masks sounds from outside as it can be more concentrated and projected in a way that dampens and masks any sound that may enter the work-station. For example, a speaker may be configured within the work-station and configured to project sound into the interior volume of the work-station. In an exemplary embodiment, a sound masking device is configured between the floor or bottom of the work-station and the ceiling of the work-station and configured to project sound vertically, up or down, within the work-station. In an exemplary embodiment, a sound masking device is configured proximal the bottom of the work-station and projects sound substantially upwards within the work-station. For example, a work-station may be configured with a sound masking device, or speaker within the ceiling that project a masking sound downward into the work-station. In another exemplary embodiment, a work-station comprises a sound masking device or speaker in a work surface, and projects a masking sound upward toward the ceiling of the work-station. For example, a work-station may have one or more speakers attached to the left-side and/or right side walls, proximal the bottom and configured to project a masking sound upward and/or across the work-station. A masking sound may be projected in a direction that extends across the open face of the work-station, wherein the masking sound is projected vertically or horizontally across the open face of the work-station. Any sound entering the work-station will be effectively masks as it will encounter the masking sound waves upon entry into the work-station. The masking sound may be projected in a manner to create a sound masking curtain across the entrance or open face of the work-station.

A sound masking device may produce a sound having one or more frequencies. In an exemplary embodiment, the masking sound includes a first frequency and a phase offset frequency, or a first sound wave that is 90 degrees offset from a second sound wave. In an exemplary embodiment, a sound masking device produce a first sound wave that is representative of female voice frequencies, such as about 50 Hz to 100 Hz, and a sound wave that is representative of male voices, such as about 20 Hz to 60 Hz.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
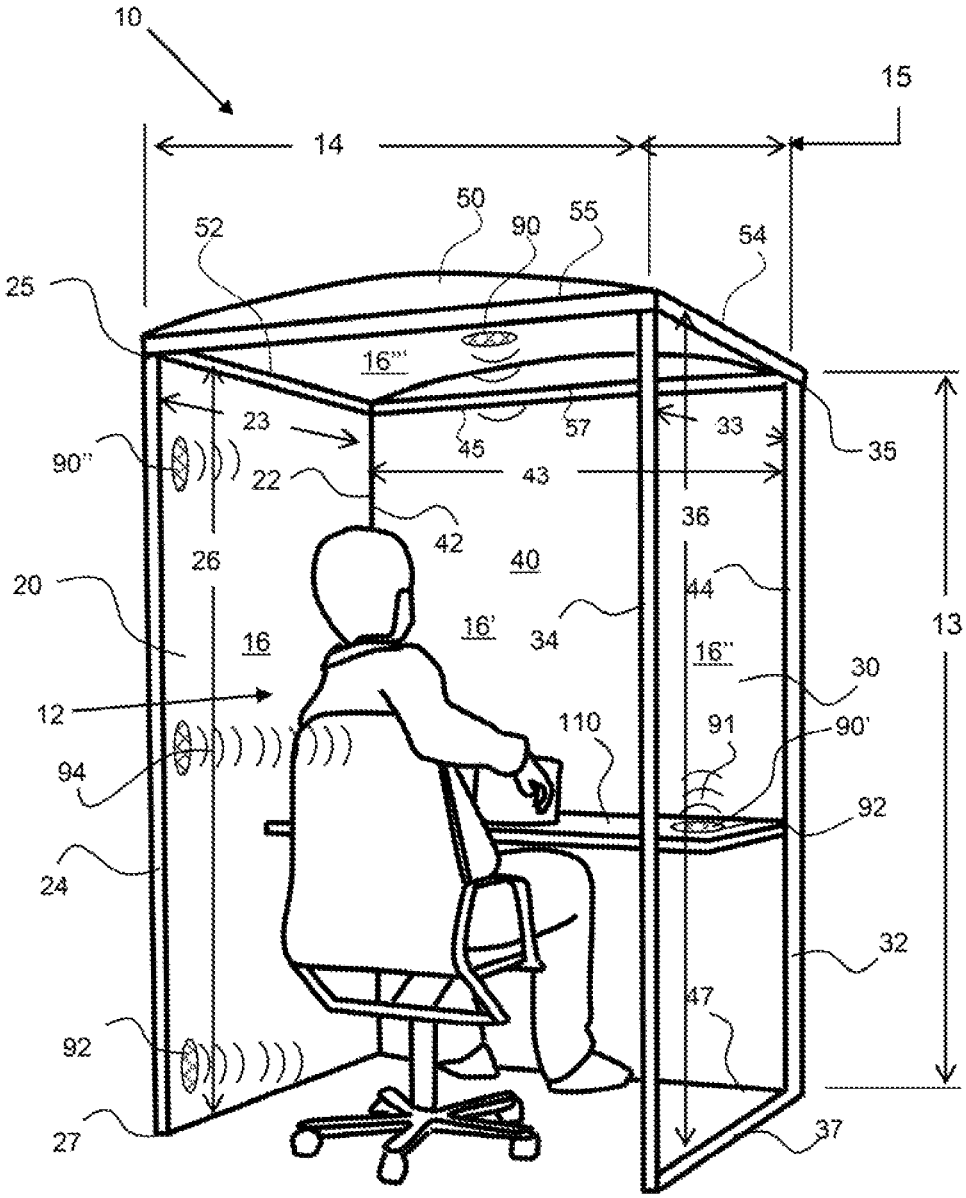
FIG. 1 shows an exemplary work-station having three wall panels and a ceiling panel.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

As shown in FIG. 1, an exemplary work-station 10 has translucent enclosure panels 16-16''' that forms an enclosure having an entrance opening 12. The work-station comprises a left-side wall 20, a right-side wall 30 and a connector wall 40. A ceiling, or ceiling panel 50 that extends over the top of the wall work-station and is connected to the three wall panels. The left-side wall 20 has a width 23 from an attached end 22 to an extended end 24, wherein the attached end 22 is attached to the connector wall 40 and the extended end boarders the entrance opening 12. The left-wall has a height 26 from the bottom 27 to the top 25. The right-side wall 30 has a width 33 from an attached end 32 to an extended end 34, wherein the attached end 32 is attached to the connector wall 40 and the extended end 34 boarders the opening 12. The right-wall has a height 36 from the bottom 37 to the top 35. The connector wall 40 has a width 43 from the left attached end 42 to the right attached end 32 and a height from a bottom 47 to a top 45, which may be the same as the left-side and right-side wall heights The ceiling or ceiling panel 50 has a left attached end 52, a right attached end 54, a front opening side 55 and a back side 57. The work-station has a height 13, width 14 and depth 15 that are measured along the inside surface and define an internal volume produced by the enclosure. A plurality of work-stations may be attached together and share a wall. For example, a second work-station may be attached to and share the left-side wall 20 with the work-station 10 shown in FIG. 1 and a third work-station may be attached to and share the right-wall 30 of the work-station 10 shown in FIG. 1. The work-station 10 has a work surface 110 that extends from the connector wall, horizontally across the width 43 of the work-station. The work-surface may be attached to the connector wall and/or the left-side and right-side walls. A plurality of sound masking devices 90-90" are configured within the work-station 10 and comprise a speaker 92 that produces and projects a masking sound 91 into the work-station. The sound masking device 90 is configured in the ceiling 50 and projects sound down into the works station. A ceiling sound masking device may be configured proximal to the opening 12 and project a masking sound down along the opening of the work-station, to create a sound masking curtain 94 over the opening of the work-station. The sound masking device 90' is configured in the work surface 110 and projects up vertically into the work-station. A plurality of sound masking devices 90" are configured with the left-side panel and project sound horizontally across the opening 12 of the work-station and may produce a sound masking curtain 94.

Figure 2:
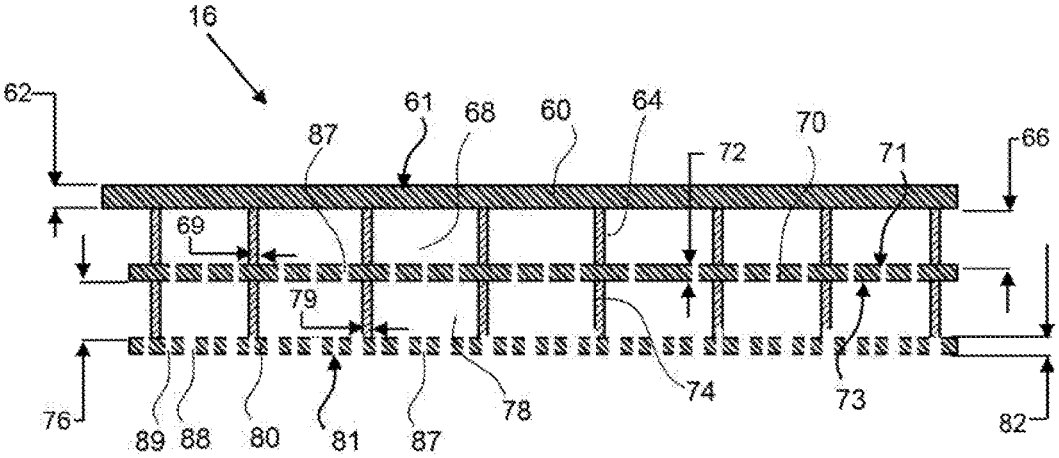
FIG. 2 shows cross-sectional view of an exemplary translucent enclosure panel.
Figure 3:
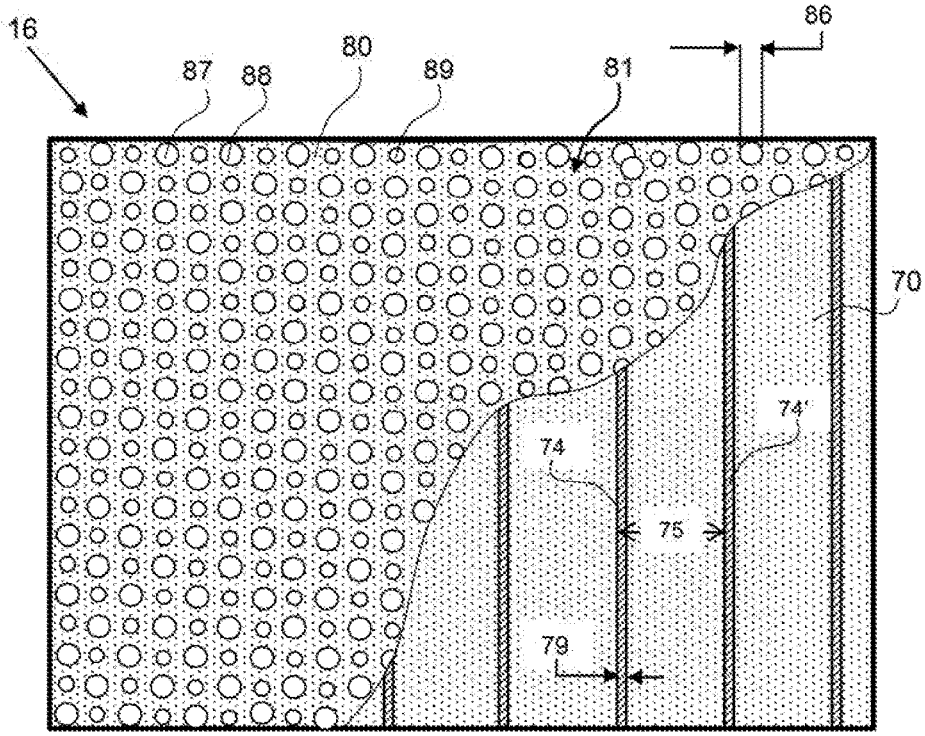
FIG. 3 shows an inside surface view of an exemplary translucent enclosure panel having a plurality of apertures through the inside panel.
Figure 4:
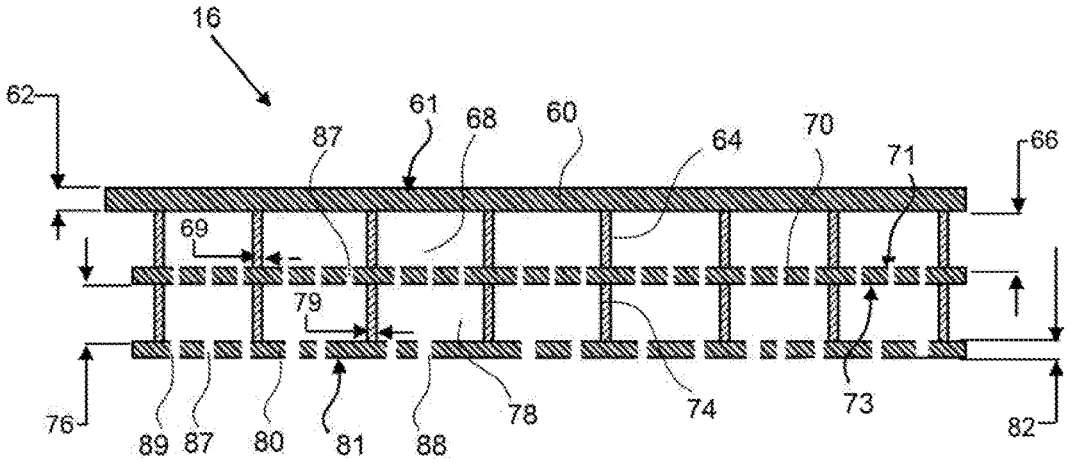
FIG. 4 shows cross-sectional view of an exemplary translucent enclosure panel.
Figure 5:
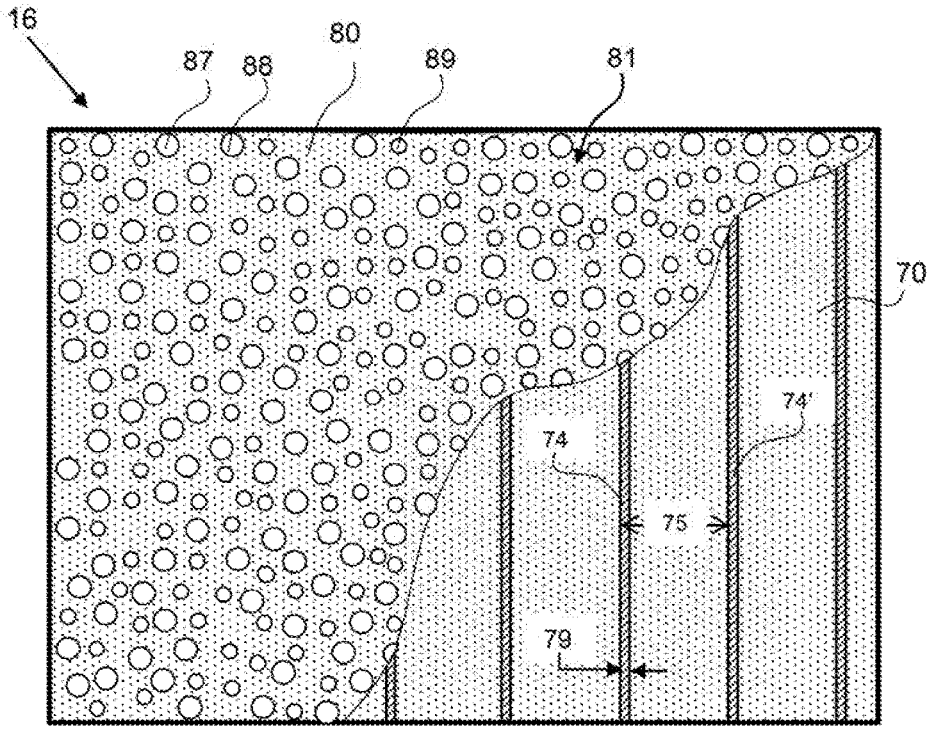
FIG. 5 shows an inside surface view of an exemplary translucent enclosure panel having a plurality of apertures through the inside panel.

Referring now to FIGS. 2 to 5, an exemplary translucent enclosure panel 16 comprises an outside panel 60, an intermediate panel 70 and an inside panel 80. The outside panel has a smooth flat surface 61 and is non-porous, having no apertures through the thickness 62 of the outside panel. The outside panel may effectively reflect sound off of the surface. The intermediate panel 70 extends between and substantially in parallel with the outside panel 60 and inside panel 80 and has a thickness 72. Outside struts 64 extend from the outside panel 60 to the intermediate panel 70 to produce outside cells 68 having a gap distance 66 from the outside panel to the intermediate panel. The outside struts have a thickness 69 and they extend substantially perpendicularly from the outside panel to the intermediate panel. The outside cells may further reduce and dampen sound from outside of the work-station. Inside struts 74 extend from the inside panel 80 to the intermediate panel 70 to produce inside cells 78 having a gap distance 76. As shown in FIGS. 2 and 3, the inside panel has a plurality of apertures 87 configured in a pattern over the inside panel surface and that extend through the thickness 82 of the inside panel and enable sound from within the work-station to enter into the inside cells. As shown in FIGS. 4 and 5 the inside panel has a plurality of randomly configured apertures 87. A first aperture 88 is larger in aperture dimension 86 than a second aperture 89. The first and second apertures are circular in shape but as described herein may be polygonal in shape, oval in shape, rectangular in shape, irregularly shaped and the like. The coverage area of the apertures over the inside panel is greater than 40%, as shown in FIG. 3. The apertures may extend over substantially the entire inside panel, such as at least 80% of the inside panel, as measured over the exposed surface area of the inside panel within a work-station. The intermediate panel also comprises a plurality of apertures 87 that extend through the thickness 72 of the intermediate panel and therefore allows some sound to pass unabated through the intermediate apertures from the outside cells 68 to the inside cells 78.

As shown in FIGS. 4 and 5, the exemplary translucent panel 16 has a plurality of apertures 87 through the inside panel that are randomly arranged and comprise a first aperture 88 and second aperture 89. Again, the first aperture is larger than the second aperture.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A four sided work-station comprising:

a. a left-side wall having an extended end and a connected end;

b. a right-side wall that is opposing said first wall, and having an extended end and a connected end;

c. a connector wall extending between the connected ends of the left-side and right-side walls to form a work area;

d. a ceiling extending over said work area and attached to the left-side wall, the right-side wall and the connector wall to form said four sided work-station having an opening for entry, e. a width, a depth and a height;

wherein the left-side wall, the right-side wall, and the connector wall all comprises a translucent panel having at least a 60% light transmission according to ASTM 01003, and comprising:

an inside panel consisting of a translucent sheet of plastic;

a solid outside panel consisting of a having no apertures therethrough and that extends parallel to the inside panel;

an intermediate panel consisting of a translucent sheet of plastic and configured between the inside and outside panels and extending in parallel with the inside and outside panels;

a plurality of inside struts that extend substantially perpendicularly from the inside panel to the intermediate panel to produce inside cells having an inside gap distance from the inside panel to the intermediate panel;

a plurality of outside struts that extend substantially perpendicularly from the outside panel to the intermediate panel to produce outside cells having an outside gap distance from the outside panel to the intermediate panel;

f. a plurality of apertures in the inside panel that allow sound to pass through the inside panel and into the plurality of inside cells to reduce sound within the work-station;

wherein the plurality of apertures have a coverage area of at least 20%;

g. a sound masking device comprising a speaker that produces a masking sound having at least two frequencies that is projected into the four-sided workstation wherein the translucent panels are obscuring translucent panels, wherein the visibility through the panels is no better than 20/30 as determined with a Snellen chart vision test positioned no more than 5 ft behind the translucent panel and wherein the translucent panels reduce sound passing therethrough, providing at least at least a 10 decibel (dB) reduction in sound.

2. The four sided work-station of claim 1, wherein the ceiling also consists essentially of the translucent panel as described in claim 1.

3. The four sided work-station of claim 1, wherein the translucent panel has a light transmission of at least 80% according to ASTM D1003.

4. The four sided work-station of claim 1, wherein the inside and outside struts have a thickness of no more than 0.25 inches.

5. The four sided work-station of claim 1, wherein the translucent panels are translucent panels, wherein the visibility through the panels is no better than 20/40 as determined with a Snellen chart vision test positioned no more than 5 ft (1.5 m) behind the translucent panel.

6. The four sided work-station of claim 1, wherein the struts extend horizontally across the translucent panels of the left-side, right-side and connector walls.

7. The four sided work-station of claim 1, wherein the inside struts have an offset distance between of more than about 0.5 inch (12.7 mm) and less than about 2.5 inches (6.35 cm).

8. The four sided work-station of claim 1, wherein the outside struts have an offset distance of no more than about 5 inches (12.7 cm).

9. The four sided work-station of claim 1, wherein the intermediate panel comprises a plurality of apertures to allow sound to enter into the outside cells and be dissipated.

10. The four sided work-station of claim 1, wherein the plurality of apertures are at least 1 mm in dimension, and no larger than 5 mm diameter.

11. The four sided work-station of claim 10, wherein the plurality of apertures are circular in shape.

12. The four sided work-station of claim 10, wherein the plurality of apertures extend only through the inside panel to allow sound within the work-station to enter and be dampened within the inside cells.

13. The four sided work-station of claim 10, wherein the plurality of apertures have a coverage area of at least 40%.

14. The four sided work-station of claim 10, wherein the plurality of apertures are configured in a pattern and over substantially the entire inside panel of the left-side wall, the right-side wall and the connector wall.

15. The four sided work-station of claim 10, wherein the plurality of apertures are randomly configured over substantially the entire inside panel of the left-side wall, the right-side wall and the connector wall.

16. The four sided work-station of claim 10, wherein the plurality of apertures are comprised of apertures of different sizes, wherein a first aperture has a first size and a second aperture has a size that is at least double the first aperture size.

17. The four sided work-station of claim 16, wherein the first and second apertures are circular in shape and wherein the second aperture has a diameter that is at least double a diameter of the first aperture.

18. The four sided work-station of claim 1, wherein the sound masking device produces a first frequency that is 90 degrees phase offset from a second frequency.

19. The four sided work-station of claim 1, wherein the sound masking device comprises a speaker that projects sound substantially in a width direction or height direction of the four sided work-station.

20. The four sided work-station of claim 1, wherein the sound masking device comprises a speaker located within the ceiling that projects sound down from the ceiling along the height direction of the work-station.

21. The four sided work-station of claim 1, further comprising a work-surface extending from the connector wall at an offset distance up from a bottom of the workstation.

22. The four sided work-station of claim 21, wherein the sound masking device comprises a speaker attached to the work-surface that projects sound up from the work surface along a height direction toward the ceiling wherein at least some of the projected sound bounces off of the ceiling, left-side, right-side and connector wall and back into the work-station.

* * * * *